United States Patent [19]

Callahan et al.

[11] Patent Number: 4,550,564

[45] Date of Patent: Nov. 5, 1985

[54] ENGINE SURGE PREVENTION SYSTEM

[75] Inventors: David J. Callahan; Robert S. Mazzawy; Howard Y. Stryker, all of Glastonbury, Conn.; James B. Kelly, Lake Worth, Fla.

[73] Assignee: United Technologies Corporation, Hartford, Conn.

[21] Appl. No.: 590,661

[22] Filed: Mar. 19, 1984

[51] Int. Cl.[4] ..... F02C 9/00

[52] U.S. Cl. ..... 60/39.093; 60/39.27; 60/39.29; 60/226.1

[58] Field of Search ..... 60/39.093, 39.27, 39.29, 60/226.1; 415/27, 28

[56] References Cited

U.S. PATENT DOCUMENTS

| | | | |
|---|---|---|---|
| 2,870,632 | 1/1959 | Gaubatz | 60/39.093 |
| 2,870,633 | 1/1959 | Harding et al. | 60/39.093 |
| 3,935,558 | 1/1976 | Miller et al. | 60/226.1 |
| 4,130,872 | 12/1978 | Harloff | 60/39.29 |
| 4,164,033 | 8/1979 | Glennon et al. | 60/39.29 |
| 4,196,472 | 4/1980 | Ludwig et al. | 60/39.29 |

*Primary Examiner*—Louis J. Casaregola
*Attorney, Agent, or Firm*—Norman Friedland

[57] ABSTRACT

A surge prevention system for a fan jet engine of an aircraft serves to manifest a signal whenever pressure distortions at the engine's inlet is calculated by judiciously located total pressure probes mounted downstream of the fan on the fan struts in the fan discharge duct. The engine's bleed valve is automatically opened to prevent surge and the fuel control's speed sensor is automatically reset to compensate for any loss of thrust. Safety switches are included to render the system inoperative whenever the aircraft is in the margin of stall and the reset feature is rendered inoperative for normal bleed open operating conditions.

14 Claims, 1 Drawing Figure

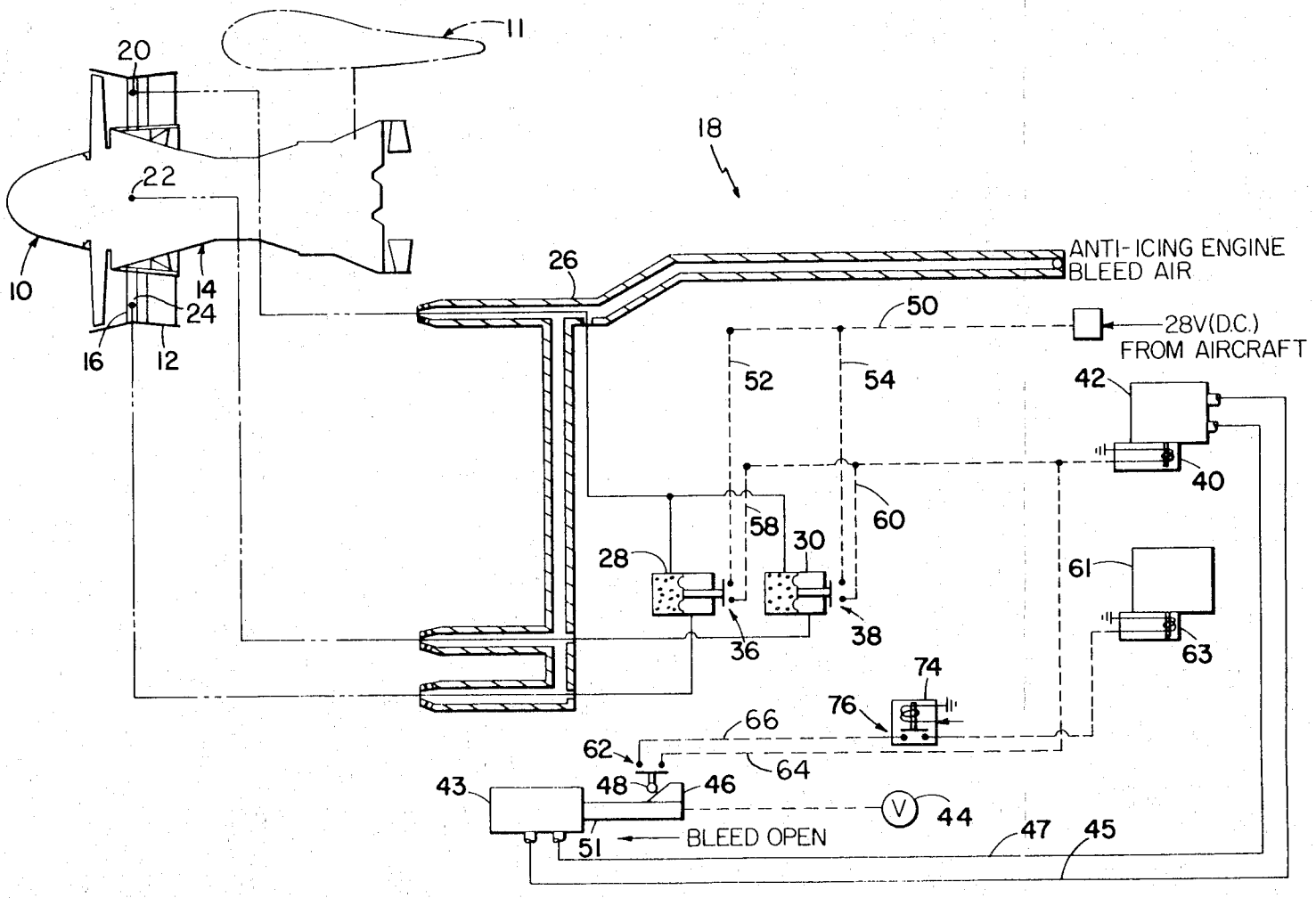
ANTI-ICING ENGINE BLEED AIR
28V(D.C.) FROM AIRCRAFT
BLEED OPEN
10
11
12
14
16
18
20
22
24
26
28
30
36
38
40
42
43
44
45
46
47
48
50
51
52
54
58
60
61
62
63
64
66
74
76

ENGINE SURGE PREVENTION SYSTEM

DESCRIPTION

1. Technical Field

This invention relates to fan jet engines powering aircraft and particularly to means for preventing surge of the engine by sensing the pressure pattern around the circumference of the fan discharge of the engine and computing the pressure distortions to produce a surge signal at a predetermined condition and automatically opening the bleed valve and resetting the fuel control.

2. Background Art

As is well known, stall is a phenomenon that may occur in the compressor of a gas turbine engine which, if allowed to persist unabated, would impair engine performance and/or lead to the destruction of the engine. While the theory of stall is not completely understood, suffice it to say that stall is that effect occasioned when sufficient number of compressor blades stall and a momentary reversing of the airflow occurs through the compressor. This causes compressor discharge pressure to drop very rapidly and sometimes results in continual pressure oscillations until some corrective action is taken.

The art has seen a number of methods intended to either sense when stall is imminent and warn the pilot so that he can take corrective action or design the engine controls such that the area of engine operation where stall is likely to occur is avoided.

For example, fuel controls limit the amount of fuel admitted to the engine during acceleration so as to accelerate along a predetermined acceleration schedule that accounts for stall. Another method, which may be contemporaneously employed with this acceleration scheduling system, is to measure compressor discharge pressure and open compressor bleed valves whenever a predetermined compressor pressure change or rate of change occurs. And still another method which is described in U.S. Pat. No. 3,867,717 and granted to John Theodore Moehring and Vigil Willis Lawson on Feb. 18, 1975 is the utilization of computed compressor pressures and turbine or exit temperatures as a means for determining when stall is present. And yet, another method is described and claimed in U.S. Pat. No. 4,060,980 granted to F. L. Elsaesser and J. H. Hall and assigned to the same assignee as this patent application. This patent describes a system that utilizes the fuel control acceleration schedule and another engine operating parameter.

While such stall detection and prevention means as described above may be effective for certain engines and/or their applications they are not always effective for other engines and/or their applications. For example, it may happen that under the same values of the computed compressor pressures or their rates and turbine temperatures or their rates another engine operation may occur which would lead to a false indication of stall; or the monitoring of the parameter may not be readily accessible or the inclusion of the sensing probes may interfere with the gas path and impair engine performance. Therefore, the selection of the stall controller comes down to what stall system is best for that engine and its application, what parameters are readily accessible, which system will provide the highest degree of accuracy, which one is fastest and a host of other considerations.

Under certain conditions, say when the aircraft undergoes a severe change in direction, the pressure pattern in the inlet becomes distorted just preceding a surge. In accordance with this invention, judiciously located total pressure probes discreetly placed around the circumference at the discharge end of the fan of the fan jet engine, detects these severe distortions at an imminent engine surge condition so as to take appropriate action to abate the surge. In this instance, the engine's compressor bleed valve which is a part of the engine's installation and its fuel control are activated. The bleeds are actuated open and the fuel control speed input signal is readjusted calling for sufficient fuel to compensate for the loss of power caused by opening the compressor bleeds. The invention contemplates negating this surge control system during certain aircraft operating maneuvers, such as upon landing and engine reverse thrust mode and in the event of having margin away from aircraft stall conditions as sensed by its existing onboard stall warning system.

DISCLOSURE OF INVENTION

An object of this invention is to provide for a fan-jet aircraft engine improved surge prevention means. A feature of this invention is the strategic location of at least two total pressure probes about the circumference in a plane downstream of the fan for sensing pressure distortions and computing their value into a signal indicative of imminent surge so as to take corrective action. Another feature of this invention is to utilize the corrective surge signal to automatically open the existing compressor bleeds and readjust the existing fuel control to adjust the thrust produced by the engine to compensate for the thrust loss incurred by the opened bleed. A still further feature of this invention is to render the entire surge system inoperative during certain flight modes of the aircraft.

The foregoing and other objects, features and advantages of the present invention will become more apparent in the light of the following detailed description of the preferred embodiment thereof.

DESCRIPTION OF THE DRAWING

The sole FIGURE is a schematic of the combined sensing circuit and electrical circuit of the surge system of this invention.

BEST MODE FOR CARRYING OUT THIS INVENTION

While in its preferred embodiment this invention contemplates utilizing three total pressure probes located at the discharge end of the fan, it is to be understood that other locations in the vicinity of the inlet of the core engine and the specific locations of each probe as well as the number of probes may vary depending on the particular application. It is, however, to be understood that the invention is intended to combat surge that would otherwise occur because of the high angle of attack of the incoming air at the inlet caused by a severe maneuver of the aircraft. The invention, besides achieving a simple surge prevention system, also avoids the necessity of redesigning the engine inlet duct which would undoubtedly sacrifice thrust specific fuel consumption.

The engine generally illustrated by reference numeral 10 is any type of fan jet engine schematically shown in part as reference numeral 11 as for example, the JT9D manufactured by Pratt & Whitney Aircraft of United Technologies Corporation for which is incorporated herein by reference suitably powering aircraft, say the 747, manufactured by the Boeing Aircraft Company also incorporated herein by reference. Suffice it to say that the engine comprises a fan stage with its annular discharge duct 12 surrounding a portion of the core engine generally indicated by reference numeral 14. As is typical in this particular installation, a plurality of struts or/and vanes 16 are circumferentially disposed in the discharge duct 12 in axial proximity to the fan blades.

According to this invention, the surge detection and prevention system generally illustrated by reference numeral 18 includes a plurality of total pressure probes (three in this instance) 20, 22, and 24 strategically located in the fan discharge duct. The particular location would depend on the particular installation and the particular maneuver of the aircraft. Thus, basically, the locations of the probe are at points where there are pressure disturbances and no pressure disturbances during a given aircraft maneuver just prior to the engine surge condition and these locations are preascertained by considering these pressure patterns from actual tests or from an analytical determination. In the preferred embodiment the three probes are mounted on the struts downstream of the fan in the locations shown by the phantom lines. One probe (20) is located in the top of the engine relative to the normal stationary position of the aircraft and where no pressure disturbances are sensed during a given aircraft maneuver. The other two probes (22 and 24) are located in the lower quadrants of the circumference say near the bottom of the engine or between and including the 90° to 270° quadrants when the most vertical quadrant is considered as 0°.

Each total pressure probe (20, 22 and 24) may be identical and are commerically available total pressure probes adapted to fit the particular installation. To assure that the sensed pressure is not influenced by icing each one is encapsulated in a tube which flows compressor discharge warm air serving to prevent icing of the probe. Concentric tube 26 and its included concentric trunk lines flow compressor air over the probes and discharge into the fan air discharge stream in fan duct 12. As would be obvious to one ordinarily skilled in this art, the ice prevention can be effectuated by utilizing electric heaters.

The sensed pressure is admitted to a pair of suitable commercially available delta (Δ) pressure sensors 28 and 30 which may include a spring biased diaphragm 32 and 34, respectively, for triggering either of the two electrical switches 36 and 38 when the pressure differential reaches a predetermined valve, say 1.9 psia. When this occurs, voltage from a suitable existing source available from the aircraft for conducting current via line to branch lines 52 & 54 in a suitable solenoid 40 (via lines 56 and branch line 58 and 60) which, in turn, activates the existing hydraulic bleed control 42. Bleed control 42 serves to apply a servo pressure from the engines existing servo system to bleed actuator 43 to position the bleed valve 44 open by applying and draining fluid to and from bleed actuator piston (not shown) via lines 45 and 47 or vice versa. Cam 46 rigidly attached to the connecting rod, contacts the follower 48 which trips an electrical switch at a predetermined position of its displacement (bleed open) for bleeding air from the compressor to prevent the stall from occurring.

Simultaneously, the speed reset solenoid 60 is placed in the active condition since one lead to switch 62 is connected to the electrical supply source. Cam 46 forces follower upwardly (as viewed in the FIGURE) to close the circuit and connecting line 64 to line 66 to excite the coil of solenoid 63. This, in turn, resets the existing speed set mechanism which is existing hardware in the engine's fuel control 61 to call for additional fuel to be supplied to the engine to increase thrust so as to compensate for the lost thrust incurred by bleeding air from the compressor.

To assure that the surge system isn't inadvertently actuated during certain engine or aircraft operating modes, the system may provide for safety mechanism. The electrical supply source from the aircraft is manifested solely when the aircraft stall indicator (aircraft existing hardware) is in the deactivated condition as sensed by the aircraft stick-shaker 70. Likewise, in certain engine modes, additional thrust is not necessary or desirable. Solenoid 74 and its switch 76 serve to render the speed reset circuit inactive, say, upon a thrust reverse or an automatic recovery mode.

Although the invention has been shown and described with respect to a preferred embodiment thereof, it should be understood by those skilled in the art that other various changes and omissions in the form and detail thereof may be made therein without departing from the spirit and the scope of the invention.

We claim:

1. A surge control system for a fan jet engine for powering aircraft, said aircraft having independent means for detecting aircraft stall, said engine having a fuel control, including compressor speed control means, for controlling the thrust generated by said engine, said compressor having means, including a bleed valve and actuator therefor, for bleeding air from said compressor, a fan discharge duct housing said fan, the surge control system including at least a pair of total pressure probes circumferentially spaced and mounted in said duct and disposed so that one of said three pair of total pressure probes is in a predetermined location that is insensitive to pressure changes occasioned by a condition of said engine going into surge and the other total pressure probe is sensitive to pressure changes in said duct occasioned by said engine going into surge, computing means responsive to said pair of total pressure probes for producing a signal indicative of an imminent surge condition, means responsive to said signal for opening said bleed valve and simultaneously resetting said compressor speed control means to increase the thrust being generated by said engine.

2. A surge control system as in claim 1 wherein said aircraft has a source of electricity, and said means responsive to said signal being an electrically conducting switch, said switch being closed upon said computing means produces a signal indicative of a predetermined pressure differential value.

3. A surge control system as is claim 2 including anti-icing means for preventing ice from forming the total pressure probe so as to falsify the value of the pressure in said duct being sensed.

4. A surge control as in claim 3 wherein said antiicing means includes concentric tubes surrounding said total pressure probes interconnecting said compressor for flowing compressor bleed air adjacent said total pressure probes.

5. A surge control system as in claim 3 wherein said means responsive to said signal includes a mechanical connection attached to said bleed valve and another electrical switch whereby said other switch closes the circuit when closed by said mechanical connection for resetting said compressor speed control means.

6. A surge control system as in claim 5 including means responsive to said independent means for detecting aircraft stall, to conduct current to said switch solely when said stall responsive means is in the inoperative mode.

7. A surge control system as in claim 6 including means responsive to engine operating parameters for rendering said means for resetting said speed control means inoperative.

8. A surge control system as in claim 7 wherein said engine operating parameter is indicative of engine thrust reversing.

9. A surge control system for a fan jet engine for powering aircraft, said aircraft having a source of electricity and independent means for detecting aircraft stall, said engine having a fuel control including compressor speed control means for controlling the thrust generated by said engine, said compressor having means, including a bleed valve and actuator therefor, for bleeding air from said compressor, a fan discharge duct housing said fan, support means supporting said duct adjacent the discharge end of said fan circumferentially spaced in said duct, the surge control system including three total pressure probes circumferentially spaced and mounted in said duct and disposed where one of said three total pressure probes is in a predetermined location that is insensitive to pressure changes occasioned by a condition of said engine going into surge and the other two total pressure probes are located so as to be sensitive to pressure changes in said duct occasioned by said engine going into surge, computing means responsive to said three total pressure probes for producing at least one signal indicative of an imminent surge condition, first means responsive to said signal for opening said bleed valve and second means responsive to said first means for simultaneously resetting said compressor speed control means to increase the thrust being generated by said engine.

10. A surge control system as in claim 9 wherein the pressure measured by said one of said three total pressure probes is compared with the pressure measured by each of said other two total pressure probes.

11. A surge control system as in claim 10 wherein each of said total pressure probes are mounted on said support means.

12. A surge control system as in claim 11 including concentric tube means surround each of said total pressure probes connected to said compressor for passing compressor bleed air over said total pressure probes to prevent ice from accumulating therein.

13. A surge control system as in claim 12 including an electrical circuit having switches responsive to said computing means for conducting current to said means responsive to said signal solely when said independent means for detecting aircraft stall is in the inoperative mode.

14. A surge control system as in claim 13 including means responsive to engine operating parameters for rendering said means for resetting said compressor speed control means inoperative.

* * * * *